US009995480B2

(12) United States Patent
Kim

(10) Patent No.: US 9,995,480 B2
(45) Date of Patent: Jun. 12, 2018

(54) BURNER

(71) Applicant: DOOSAN BABCOCK LIMITED, Crawley, Sussex (GB)

(72) Inventor: Ik Soo Kim, Renfrew Strathclyde (GB)

(73) Assignee: DOOSAN BABCOCK LIMITED, Sussex (GB)

( * ) Notice: Subject to any disclaimer, the term of this patent is extended or adjusted under 35 U.S.C. 154(b) by 740 days.

(21) Appl. No.: 14/379,688

(22) PCT Filed: Feb. 20, 2013

(86) PCT No.: PCT/GB2013/050400
§ 371 (c)(1),
(2) Date: Aug. 19, 2014

(87) PCT Pub. No.: WO2013/124642
PCT Pub. Date: Aug. 29, 2013

(65) Prior Publication Data

US 2015/0300632 A1 Oct. 22, 2015

(30) Foreign Application Priority Data

Feb. 21, 2012 (GB) ..... 1202907.0

(51) Int. Cl.
*F23D 1/02* (2006.01)
*F23C 7/00* (2006.01)

(52) U.S. Cl.
CPC ..... *F23D 1/02* (2013.01); *F23C 7/004* (2013.01)

(58) Field of Classification Search
CPC ..... F23D 1/00; F23D 1/02; F23D 2201/00; F23D 2201/10; F23D 2201/20
(Continued)

(56) References Cited

U.S. PATENT DOCUMENTS 4,274,587 A * 6/1981 Cioffi ..... F23D 1/00 110/104 B
4,497,263 A 2/1985 Vatsky et al.
(Continued)

FOREIGN PATENT DOCUMENTS

CA 1282314 C 4/1991
GB 313368 A 6/1929

OTHER PUBLICATIONS

International Preliminary Report on Patentability dated Aug. 26, 2014 issued in corresponding PCT application No. PCT/GB2013/050400.

(Continued)

*Primary Examiner* — David J Laux
(74) *Attorney, Agent, or Firm* — Sughrue Mion, PLLC

(57) ABSTRACT

A burner includes a burner inlet and outlet. The burner also includes a primary conduit defining a flow channel extending along a burner axis for conveying a mixture of fuel and gas and a secondary conduit defining a flow channel disposed about the primary conduit for conveying gas. The primary conduit defines a flow channel extending to a primary conduit outlet within the burner substantially upstream of the burner outlet, whereby the secondary conduit downstream of the primary outlet defines a common conduit for flow from the primary and secondary conduits. A swirl generation device imparts a swirl to the flow of gas from the secondary conduit upstream of the primary conduit outlet. A venturi arrangement is provided in the vicinity of the primary outlet to act on the primary flow stream to impart a flow deviation.

18 Claims, 2 Drawing Sheets

(58) Field of Classification Search
USPC ..... 110/104 B, 261, 264, 265
See application file for complete search history.

(56) References Cited

U.S. PATENT DOCUMENTS

| | | | | | |
|---|---|---|---|---|---|
| 4,702,180 | A * | 10/1987 | Kiga | F23K 3/02 | 110/106 |
| 4,838,185 | A * | 6/1989 | Flament | F23C 7/004 | 110/263 |
| 5,231,937 | A * | 8/1993 | Kobayashi | C04B 7/44 | 110/262 |
| 5,680,823 | A | 10/1997 | Larose | | |
| 6,152,051 | A | 11/2000 | Kiyama et al. | | |
| 6,715,432 | B2 | 4/2004 | Tsumura et al. | | |
| 7,770,528 | B2 | 8/2010 | Okazaki et al. | | |
| 2009/0000532 | A1 | 1/2009 | Ehmann | | |
| 2010/0162930 | A1* | 7/2010 | Okazaki | F23C 7/008 | 110/190 |
| 2010/0223926 | A1* | 9/2010 | Orita | F23C 9/003 | 60/670 |

OTHER PUBLICATIONS

Search Report of GB1202907.0 dated Jun. 16, 2012.
International Search Report of PCT/GB2013/050400 dated May 2, 2013 [PCT/ISA/210].

* cited by examiner

BURNER

CROSS REFERENCE TO RELATED APPLICATIONS

This is a National Stage of International Application No. PCT/GB2013/050400 filed Feb. 20, 2013, claiming priority based on GB Patent Application No. 1202907.0 filed Feb. 21, 2012, the contents of all of which are incorporated herein by reference in their entirety.

The invention relates to a burner, and in particular a burner for the combustion of particulate carbonaceous fuel, adapted for reduced NOx emissions. In the preferred case the invention relates to a pulverous fuel burner such as a pulverous coal fired burner. For example the invention relates to a burner for use in a power generation apparatus and to a power generation apparatus including one or more such burners.

BACKGROUND

In general terms, a low NOx burner for combustion of particulate carbonaceous fuel may comprise a number of components, which may include:

- a primary conduit to supply the pulverous fuel and a conveying gas which may be a comburant gas (often known as "primary" air);
- a number of channels arranged for example concentrically around the pulverous fuel supply, through which comburant gas and other gas is supplied; in a low NOx burner there will typically be two or more channels for the combustion air or other comburant gas and these are often known as "secondary" air, "tertiary" air, etc;
- devices to induce a swirling motion into the gas flows for example in the secondary and tertiary (etc.) channels;
- devices to stabilise the flame, often placed on the end of the fuel supply pipe and sometimes known as the "flame-holder";
- devices placed inside the fuel supply pipe to control the fuel distribution at the outlet of that pipe;
- supplementary equipment, such as igniters, light-up burners, flame monitoring sensors, etc., optionally installed in a separate tube, which may be located centrally within the fuel pipe where it is known as the "core" tube; the core tube may have its own air or other gas supply; alternatively supplementary equipment may be installed in other locations in the burner or close by.

Where "air" is used herein both with reference to the prior art and with reference to the invention the skilled person will readily appreciate that other oxygen containing comburant gases and mixtures may be substituted in the familiar way for example for oxyfuel firing including a comburant gas having a reduced nitrogen content relative to air, for example comprising mixtures of pure oxygen and/or recycled flue gas and/or air. References to a comburant gas will be understood to include mixtures of gases including gases capable of supporting combustion and other gases.

It is known by those knowledgeable in this area that there are a number of variant low NOx burner designs available. Implicit in the design of any low NOx burner is the requirement to ensure that there must be sufficient oxidant in any oxidant/fuel mix to support the combustion of the fuel and to maintain the stability of the flame.

SUMMARY

Alternative arrangements of burner design which are effective in reduction of the amount of nitrogen oxides emitted as byproducts during combustion of a particulate fuel, such as pulverized coal, are generally desirable.

According to the invention there is provided a burner having a burner inlet for receiving a supply of combustible pulverous fuel and a supply of comburant gas and a burner outlet in the vicinity of which combustion of the fuel is supported during use; said burner comprising:

a primary conduit defining a flow channel extending along a burner axis for conveying a mixture of fuel and a gas such as a comburant gas;

a secondary conduit defining a flow channel disposed about the primary conduit for conveying gas such as a comburant gas;

wherein the primary conduit defines a flow channel extending to a primary conduit outlet within the burner substantially upstream of the burner outlet, whereby the secondary conduit downstream of the primary outlet defines a common conduit for flow from the primary and secondary conduits; and a swirl generation device is provided to impart a swirl to the flow of gas from the secondary conduit upstream of the primary conduit outlet; and a venturi arrangement is provided in the vicinity of the primary outlet such as to act on the primary flow stream to impart a flow deviation outwardly away from axial to the mixture of fuel and gas from the primary conduit.

The burner of the invention is thus distinctively characterised by three features in particular in combination.

First, the primary conduit extends only a part of the axial extent of the burner to an outlet substantially upstream of the burner outlet, whereat the primary flow lets into the volume defined by the secondary conduit, which thus defines for a substantial downstream length of the burner from the primary conduit outlet to the burner outlet a common flow channel for the combined flow from the primary and secondary conduits.

Second, a swirl is imparted to the secondary flow via a suitable swirl generation device, for example in that the secondary conduit includes a swirl generation device upstream of the primary conduit outlet to impart a swirl to the flow of gas therein or additionally or alternatively in that the common conduit includes a swirl generation device located to act on the flow from the secondary conduit in the downstream vicinity of the primary conduit outlet to impart a swirl to the flow of gas thereto.

Third, a flow deviation outwardly away from axial is imparted to the primary flow via a suitable venturi arrangement, for example in that the primary conduit includes a venturi arrangement upstream of the primary conduit outlet to impart a flow deviation outwardly away from axial to the mixture of fuel and gas therein or additionally or alternatively in that the common conduit includes a venturi arrangement to act on the flow from the primary conduit in the downstream vicinity of the primary conduit outlet to impart a flow deviation outwardly away from axial to the mixture of fuel and gas therefrom.

The effect of this combination is to create a mixing zone within the burner in the common flow channel for the combined flow from the primary and secondary conduits downstream of but in the vicinity of the primary conduit outlet in which at least partial mixing of the primary flow and the secondary flow takes place.

Subject to these basic features, a burner of the invention admits additional elements to supply material to the burner outlet and/or to support combustion and flame stability at the burner outlet and/or to facilitate mixing of one or more flow streams.

For example typically the burner will further comprise a core conduit defining a flow channel extending along a burner axis for conveying a further gas flow such as a further comburant gas flow. In this case a primary conduit defines a flow channel for conveying a mixture of fuel and comburant gas disposed about the core conduit, for example coaxially.

For example optionally the burner may further comprise at least one further conduit, for example one or more tertiary or higher order conduits comprising further flow channels for the supply of further gases such as further comburant gases to the combustion site at the burner outlet. Typically such a further conduit is disposed about the secondary conduit, for example coaxially therewith. Typically such a further conduit may comprise a swirl generation device to impart a swirl to the flow of gas therein.

For example additionally a venturi arrangement may be provided in the vicinity of the primary outlet such as to act on the secondary flow stream to impart a flow deviation inwardly away from axial to gas flow from the secondary conduit. For example the secondary conduit may include a venturi arrangement to impart a flow deviation inwardly away from axial to the gas therein or additionally or alternatively the common conduit may include a venturi arrangement positioned to act on the flow from the secondary conduit in the downstream vicinity of the primary conduit outlet to impart a flow deviation inwardly away from axial to the secondary gas flow.

For example additionally the primary conduit may include a swirl generation device upstream of the primary outlet to impart a swirl to the flow of fuel and gas therein.

The basic concept of the design of a burner in accordance with the invention is such as to define a mixing zone in which at least partial mixing of the primary stream and the secondary stream takes place within the burner substantially upstream of the burner outlet.

The mixing zone is created within the burner substantially upstream of the burner outlet because the primary conduit defines a flow channel extending to a primary conduit outlet within the burner substantially upstream of the burner outlet. For example the primary conduit extends along the length of the burner from a burner inlet towards a burner outlet in the vicinity of which combustion of the fuel is supported during use for a distance of no more than 70% of the length of the burner, and for example for a distance that is about half of the length of the burner. A preferred location may be decided by a desired primary fuel distribution. The primary fuel distribution can be controlled by aspects of design and location of the primary venturi formation(s), but a preferred location will be such as to define a flow channel extending from a primary conduit outlet substantially upstream of the burner outlet and for example at about half of the length of the burner.

The mixing zone is thus created substantially in advance of the burner outlet and a common conduit for the at least partly mixed primary and secondary flows thus extends a substantial distance within the burner from the mixing zone to the burner exit.

The mixing zone is conveniently located in the downstream vicinity of the outlet of the primary conduit. At this location, the primary stream is diverted outwardly from an axial direction by a suitable venturi arrangement, and caused to mix with the secondary stream which has been imparted with a swirl by a suitable swirl device upstream of the mixing zone, and which may also have been diverted away from axial flow direction inwardly to impinge upon the primary stream. A particular desired purpose of this mixing arrangement is to produce a particulate fuel distribution as described below.

With appropriate selection of venturi and swirl angles and flow rates it is possible to create an effect whereby as a result of the partial mixing of the primary and secondary streams, the centrifugal force is acting on the particulate fuel tend to create two distinct high fuel concentration zones within the common conduit downstream of the mixing zone, and in particular tend to create two concentration zones at the burner exit. Particulate fuel tends to concentrate and produce fuel rich zones both towards the inside and towards the outside of the flow stream in the common conduit downstream of the mixing zone. For example in a typical burner design, an annular fuel rich zone will be formed towards an outer conduit wall defining the outside of the common flow channel, and the further fuel rich zone will be formed towards an inner conduit wall defining the inside of the common flow channel. A more fuel lean zone will tend to form between these two fuel rich extremes.

Thus, a particulate fuel distribution within the common conduit downstream of the mixing zone, and for example at the burner exit, when measured axially across the burner, will tend to define a u-shaped distribution, with fuel rich zones at the inner and outer extremities of the flow and a less fuel rich zone between.

This enables a distinct pattern of fuel rich and fuel lean zones to be provided in a combustion region beyond the burner exit, which allows the potential for a better control of the fuel-comburant mix, a better control of the flame, and potentially shorter flame length. The flame arrangement offers the potential for more complete recombustion of initially generated oxides of nitrogen, producing the potential for lower overall NOx emissions.

In a typical burner arrangement, the outer fuel rich zone is optimally distributed for mixing with tertiary air from a tertiary conduit to form an optimised outer reaction zone in the combustion region, and an inner fuel rich flow is optimally located to mix with core air to form an inner reaction and recirculation zone within the combustion region.

In an optimised design in accordance with the principles of the burner of the invention, the venturi and swirl arrangements are suitably designed and adapted to produce and optimise the distinctive fuel density distribution actually across the flow zone defined by the common conduit downstream of the mixing zone, and in particular at the burner exit as above described. It is a distinctive characteristic of the invention in the preferred embodiment that the venturi and swirl arrangements in the primary and/or secondary conduits are so disposed and configured as to produce a u-shaped axial distribution of particulate fuel concentration in the flow zone in the common conduit downstream of the mixing zone as above defined, and in particular are so disposed and configured as to produce a u-shaped axial distribution of particulate fuel concentration at the burner exit.

With this design objective in mind, various arrangements of conduit, venturi and swirl generation device will readily suggest themselves to the skilled person.

For example, a conduit may comprise any suitable arrangement defining and elongate flow channel. Each of the primary and secondary conduits and if applicable tertiary, higher order and core conduits may each comprise one or more elongate structures defining elongate flow channels. Where a conduit comprises plural flow channels they are for example generally parallel. In a familiar design, core, primary, secondary and tertiary or higher order conduits may be disposed about each other for example axially to define axial flow in a burner elongate direction. For example, a core conduit where present may be provided along a burner axis, a primary conduit may be disposed therearound, a secondary conduit disposed further therearound, and tertiary or higher order conduits disposed further therearound to define parallel axial flow channels in a burner elongate direction. Such an arrangement will be familiar.

Typically for example concentric and/or coaxial tubes such as concentric and/or coaxial cylinders may define annular flow regions or sectors thereof for the primary, secondary and higher order conduits. For example, annular flow channels comprising single or plural annular sectors may make up the primary flow, secondary flow and tertiary flow as desired.

Swirl generation devices may be placed in one or more of the flow channels within one or more of the conduits as desired. For example, such a flow generation device may be present at least in the secondary flow within the secondary conduit upstream of the mixing zone. Additional flow generation devices may be provided in the primary flow upstream of the mixing zone, and in the tertiary or higher order flows.

Any suitable swirl generating device such as may be familiar to the person skilled in the art may be envisaged as suitable for the invention. For example a swirl generation device may be configured to impart an axial swirl, a radial swirl, or some other swirl pattern to the flow within its respective conduit. For example a swirl generation device may be a fixed vane swirler, a variable vane swirler, or similar, or other suitable formation to impart a desired swirl pattern to the flow within its respective conduit.

In accordance with the invention a venturi arrangement is provided at least in association with the outlet of the primary conduit to divert the primary flow outwardly away from an axial direction and to facilitate in use the mixing of the primary flow with the swirled secondary flow for example in a mixing zone immediately downstream of the outlet of the primary conduit within the burner. In a preferred case a venturi arrangement is provided within the primary conduit upstream of the primary conduit outlet. The main role of the venturi arrangement in the primary flow is to divert the fuel/gas to mix with the secondary flow. An advantageous additional effect may be to distribute the fuel and gas more evenly in the primary conduit. The preferred venture location, size and structure may be varied with operating conditions in mind.

Optionally additionally a further venturi arrangement diverts the secondary flow inwardly away from an axial direction towards the primary flow to further facilitate mixing. The invention is not limited to a particular venturi arrangement, but a convenient venturi arrangement may comprise a portion of the primary or secondary flow channel as the case may be that is structured to divert flow within the channel away from an axial flow direction as required and thus for example comprise a portion of the primary or secondary flow channel as the case may be that is itself structured to deviate away from an axial direction. For example a venturi arrangement may be a structure formed so as to create an angled deviation away from axial in an inner or outer wall, or both, defining such a flow channel.

Swirl generation structures and venturi formations are adapted to produce a desired swirl angle or venturi angle as the case may be in familiar manner. Optimised angles may be determined by various other aspects of burner design and of use parameters, but in a preferred embodiment a secondary swirl angle of 30-60 degrees and/or a secondary venturi angle of 20-40 degrees, and more preferably 25-30 degrees, and/or a primary air venturi angle of 20-40 degrees and more preferably 25-30 degrees might be suitable.

In a possible embodiment, a venturi may be located in a conduit portion structured to define a flow channel having a reduced cross-sectional area to facilitate the flow deviation effect.

In a possible embodiment, the common conduit for common flow of the primary and secondary flows is preferably structured to define a flow channel having a cross-sectional area that increases forwardly of the mixing zone. For example an outer wall of the common conduit for common flow of the primary and secondary flows is conveniently provided with an outward flare forwardly of the mixing zone, for example of less than 10 degrees. The flare is intended to reduce velocities to improve mixing after impinging of the primary and secondary streams, too overcome turbulence etc.

The common conduit for common flow of the primary and secondary flows may be structured to define a flow channel having a cross-sectional area that decreases immediately before the burner outlet. A flame holder structured in familiar manner is preferably provided at the burner outlet.

Preferably, the burner of the invention is adapted for the combustion of particulate carbonaceous fuel and in the preferred case is a pulverous fuel burner. Preferably, the burner comprises a source of particulate carbonaceous fuel to supply fuel to a burner inlet, and in particular at least to an inlet of the primary conduit.

Preferably, the pulverous fuel burner is a pulverized coal burner, for example a burner for pulverized bituminous coal or dried pulverized lower rank coal. Consequently preferably the pulverous fuel is pulverized coal, for example pulverized bituminous coal or dried pulverized lower rank coal. Alternatively, the burner of the invention may be adapted for the combustion of pulverous carbonaceous fuel such as biomass, pulverous carbonaceous waste material, etc.

In a more complete aspect of the present invention, there is provided a combustion apparatus comprising:

a combustion chamber; and at least one and preferably a plurality of burners as hereinbefore described located so as to define combustion sites within the combustion chamber.

Preferably the combustion apparatus comprises a boiler for generating steam.

Preferably the fuel used is particulate carbonaceous fuel and in the preferred case is a pulverous fuel, most preferably pulverized coal.

BRIEF DESCRIPTION OF THE DRAWINGS

An embodiment of the present invention will now be described, by way of example only, with reference to FIGS. 1 to 4 of the accompanying drawings, in which.

DETAILED DESCRIPTION

Figure 1:
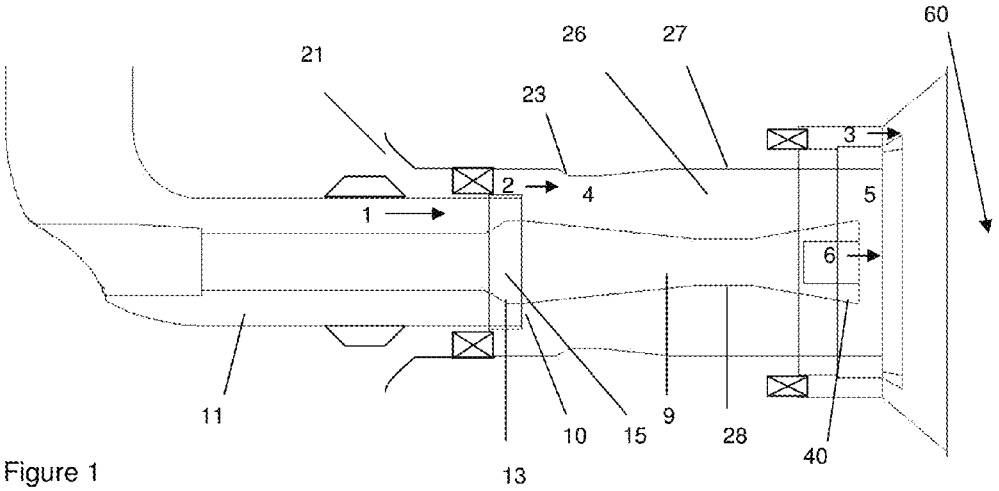
FIG. 1 is a sectional side view of a burner to which the principles according to the invention have been applied.
Figure 2:
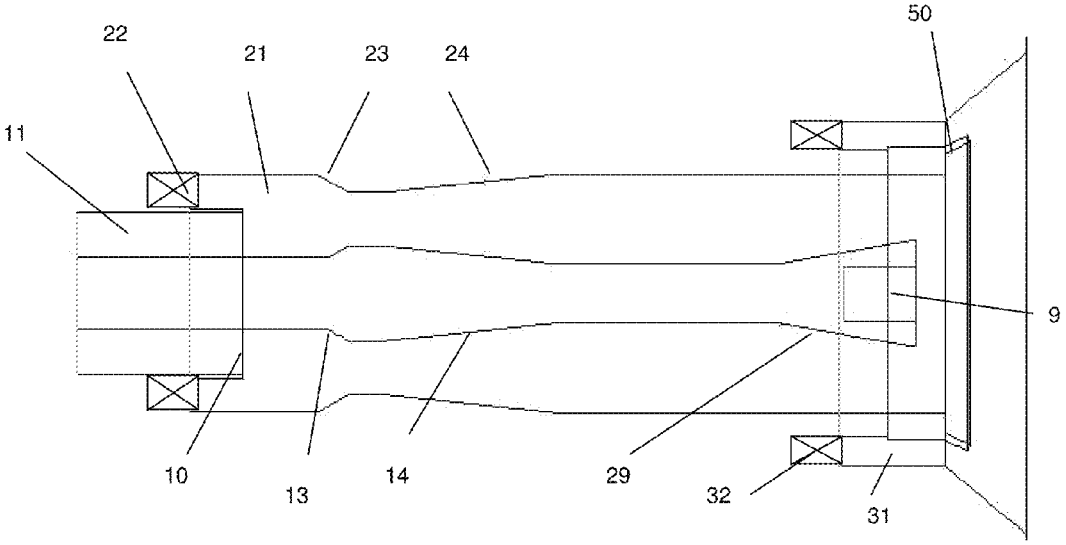
FIG. 2 is a simplified sectional side view of the forward part of a burner to which the principles according to the invention have been applied.

FIG. 1 is a sectional side view of a burner of an embodiment of the invention, and FIG. 2 is a more detailed simplified view of the forward part of a simplified burner representing a more simplified embodiment of the invention. For the most part components and principles are common to both arrangements. In particular both illustrate the principle of the mixing zone whereby the distinctive particulate fuel distribution which characterises the preferred use of the invention may take place. Like reference numerals are used for equivalent components in the two figures.

Referring to the figures, a low NOx burner is shown in each case which comprises, in generally conventional manner, a core conduit defining a core flow channel 9 for core air (CA), a primary conduit defining a primary flow channel 11 for a mixture of primary air and particulate fuel (PA), which in the example embodiment is pulverised coal, a secondary conduit defining a secondary flow channel for secondary air 21 (SA), and a tertiary conduit defining a tertiary flow channel 31 for tertiary air (TA).

The core air conduit extends in an elongate direction along the burner axis, with the primary, secondary and tertiary conduits respectively disposed around it in coaxial manner in an arrangement which will be generally familiar to the person skilled in the art. However, a number of specific modifications can be identified that are common to each embodiment, in particular with the purpose of creating at least partial mixing of the primary and secondary air streams at a point within the burner substantially upstream of the burner outlet and combustion zone 60.

First, the primary conduit defines a primary outlet 10 which sits substantially upstream of the burner outlet. As a result flow in the primary channel 11 and flow in the secondary channel 21 are caused to come together and flow into and through a common flow channel 26 which is defined as the annular space between the inner wall of the forward extension of the outer secondary conduit wall 27 and the outer wall surface of the inner conduit wall 28.

Second, various structural and configurational modifications are made in the vicinity of the outlet of the primary conduit to facilitate a degree of mixing of the primary and secondary air flows within the burner in the mixing zone so defined substantially upstream of the burner outlets and combustion zone. Swirl generation devices 22 are provided in the secondary air flow. Venturi formations 13 in the form of angular deviations in the inner wall of the primary conduit immediately upstream of the primary conduit outlet 10 (FIG. 1) or of the common conduit immediately downstream of the primary conduit outlet 10 (FIG. 2) serve to deflect the primary air/fuel mix flow away from an axial direction and outwardly towards the secondary air flow. Venturi formations 23 in the form of angular deviations in the secondary conduit outer wall serve to divert the swirling secondary air flow away from an axial direction and towards the primary air/fuel mix. As shown in FIGS. 1 and 2, inwardly tapering angular deviation 14 of the surface of a bullet shaped formation 15 complements the outward tapering angular deviation that forms the venturi formation 13, and outwardly flaring angular deviation 24 of the wall of the secondary conduit reverses the inwardly flaring angular deviation that creates the venturi formation 23.

In the embodiment illustrated in FIG. 1, a venturi formation in the form of a deflection surface 13 is provided within the primary conduit immediately upstream of the primary conduit outlet 10. This is considered a preferred design. In the simplified schematic of FIG. 2 the deflection surface making up the venturi formation is provided immediately downstream of the primary conduit outlet. Such an arrangement may also be effective. The purpose of the venturi arrangement is to deflect the primary flow away from an axial direction to facilitate mixing of the primary air/fuel mix with the secondary air flow.

The core air conduit flows to a core outlet 29. The tertiary air conduit includes swirlers 32.

The structure thereby defines some principal flow zones as follows.

Figure 3:
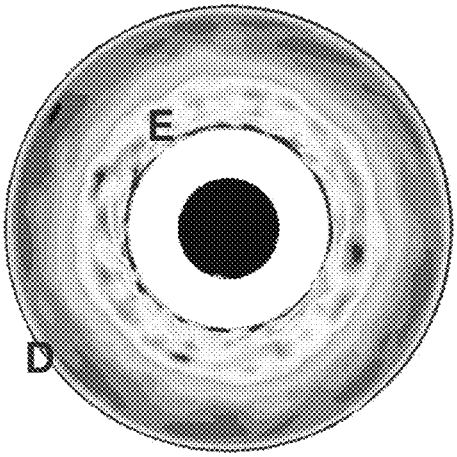
FIG. 3 is a cross-sectional schematic through the flow through the burner at the exit to illustrate fuel density distribution.
Figure 4:
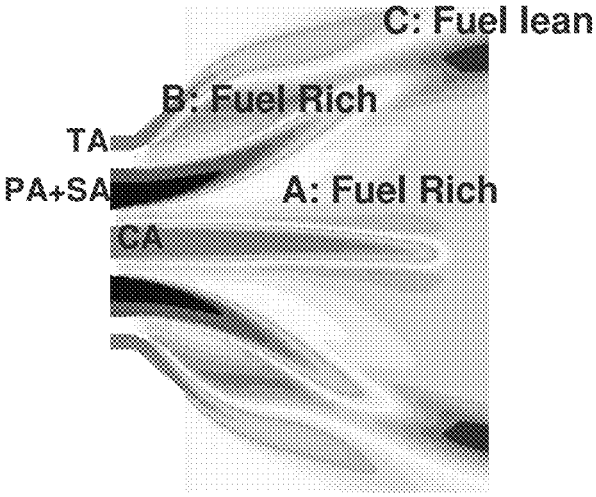
FIG. 4 is an illustration of the flame distribution produced by the fuel density distribution of FIG. 3.

A primary flow zone for flow of primary air and particulate fuel mix flows in the direction of the arrow 1. A secondary flow of swirled secondary air flows in the direction of the arrow 2. A swirled tertiary flow flows in the direction of the arrow 3. A core air flow flows in the direction of the arrow 6. A mixing zone 4 is defined by the venturi structures. In this mixing zone a degree of at least partial mixing occurs of the primary air and fuel with the secondary air. This is intended to produce the fuel distribution set out in the description of FIGS. 3 and 4 as the flow continues through the common conduit 26 defined by the onwards continuation of the secondary conduit wall 27 and by the inner wall 28. In particular, this is intended to produce a fuel distribution across the annular common conduit at the burner exit 5 which is essentially as illustrated in FIG. 3 so as to produce the flame structure essentially as illustrated in FIG. 4.

The concept of operation in an example case can be discussed with reference to the fuel distribution illustrated in FIG. 3 and the resultant flame structure illustrated in FIG. 4 and via a consideration of the flow zones identified as zones 1 to 6 in FIG. 1.

In example operation the following are present as zones 1 to 6 in FIG. 1.

1: Primary Air+Coal (PA) (~25 m/s)
2: Secondary Air (SA), Swirl (~30 m/s)
3: Tertiary Air (TA), Swirl (~30 m/s)
4: PA and SA mixed partially (~32 m/s)
5: Providing two distinct mixing areas or even mixing distribution (but overall mixing is around an air-fuel stoichiometric ration of 0.5 for PA and SA mixing) (~30 m/s)
6: Core air (kept small mass flow rate).

Structures to effect this include the bullet shaped portion 15 which creates a venturi effect via the surface 13 and serves to distribute PA+PF evenly in PA pipe (location and size can be different with operating conditions); the SA venturi 23 to deflect SA stream 2 to mix it with 1 (location and size are variable); the bluff body 40 to stabilise the flame and shape the internal re-circulation zone within the flame structure; and the flame holder and mixer 50 acting zones 3 and 5.

In use mixing of stream 1 and 2 tends to produce two separated partially or largely fully premixed zones in order to create two reaction zones near the burner. Swirled SA contacts with PA and the centrifugal force of SA carries some coal to outside of the pipe. This generates two separated mixing streams within the pipe in order to sustain two reaction regimes.

As is illustrated in FIG. 3, a broadly u-shaped distribution outwardly in a radial direction is created, in which there is a concentration of particulate fuel towards the outside of the annulus defining the common conduit (D) and a further concentration towards the inside of the annulus defining common conduit (E).

Initially PA and SA are partially premixed within the pipe to provide good burning conditions of the inner fuel concentration zone E with SA immediately at the burner exit. Subsequently the mixing of the outer fuel concentration zone D with TA forms another reaction zone.

As shown in FIG. 4, a fuel lean zone (C) will be formed between a fuel rich reaction zone (B) where the outer fuel concentration D is mixed with TA and a fuel rich reaction zone (A) where the inner fuel concentration E is mixed with CA.

In the fuel rich reaction zone (B) surrounding oxidant is consumed to provide flue gas to the main NOx reduction zone A. Therefore it provides additional staging effect and improves NOx reduction. The fuel rich reaction zone A is formed by E coal with CA. In this zone the fuel NOx may be consumed. However it should maintain sub-stoichiometry in order to ensure fuel NOx reduction.

The invention claimed is:

1. A burner having a burner inlet for receiving a supply of combustible pulverous fuel and a supply of comburant gas and a burner outlet in the vicinity of which combustion of the fuel is supported during use; said burner comprising:

a core conduit defining a flow channel along a burner axis;

a primary conduit disposed around the core conduit, an inner wall of the primary conduit and an outer wall of the core conduit defining a primary flow channel extending along the burner axis for conveying a comburant gas that includes a mixture of fuel and gas;

a secondary conduit defining a secondary flow channel at least partially disposed around the primary conduit for conveying a comburant gas;

wherein the primary flow channel extends to a primary conduit outlet within the burner substantially upstream of the burner outlet, wherein the secondary conduit defines a common conduit downstream of the primary conduit outlet for flow from the primary and secondary conduits, so as to define an annular space between an inner wall of the secondary conduit and the outer wall of the core conduit for a common flow for the comburant gas of the primary conduit and the comburant gas of the secondary conduit to a vicinity of the burner outlet;

a swirl generation device provided in the secondary conduit and upstream of the primary conduit outlet to impart a swirl to the flow of gas from the secondary conduit upstream of the primary conduit outlet;

a venturi arrangement provided in the vicinity of the primary conduit outlet at a location immediately upstream of the primary conduit outlet or immediately downstream of the primary conduit outlet, wherein the venturi arrangement includes an outwardly extending deviation portion formed by the outer wall of the core conduit which causes a flow deviation, outwardly away from an axial direction, to cause mixing of the common flow of the comburant gas from the primary conduit and the comburant gas from the secondary conduit, wherein the mixing occurs downstream from the venturi arrangement and in a location in the common conduit that is upstream of the burner outlet;

a tertiary conduit disposed around the secondary conduit to define parallel axial flow channels in a burner elongate direction, wherein each of the core, primary, secondary and tertiary conduits comprise concentric and/or coaxial tubes such as concentric and/or coaxial cylinders or annular sectors thereof.

2. The burner in accordance with claim 1 wherein a second venturi arrangement is provided in the secondary conduit in the vicinity of the primary conduit outlet to impart a flow deviation inwardly away from the axial direction to the comburant gas flow in the secondary conduit.

3. The burner in accordance with claim 1 wherein the primary conduit extends along the length of the burner from the burner inlet towards the burner outlet in the vicinity of which combustion of the fuel is supported during use for a distance of no more than 70% of the length of the burner.

4. The burner in accordance with claim 3 wherein the primary conduit outlet is located at a distance from the burner outlet that is about half of the length of the burner.

5. The burner in accordance with claim 1 arranged to define a mixing zone for at least partial mixing of the primary and secondary flows in the downstream vicinity of the primary conduit outlet.

6. The burner in accordance with claim 1 arranged to produce in use a particulate fuel distribution within the common conduit downstream of the mixing zone when measured axially across the burner that has a u-shaped distribution, with fuel rich zones at the inner and outer extremities of the flow within the common conduit and a less fuel rich zone between.

7. The burner in accordance with claim 1 wherein the venturi arrangement comprises a portion of the primary or secondary flow channel configured to divert flow within the channel away from an axial flow direction.

8. The burner in accordance with claim 7 wherein the venturi arrangement is configured to create an angled deviation away from axial in an inner or outer wall, or both, defining said flow channel.

9. The burner in accordance with claim 1 wherein the swirl generation device acting on the flow from the secondary conduit is adapted to impart a secondary swirl angle of 30-60 degrees.

10. The burner in accordance with claim 1 wherein a venturi arrangement acting on the flow from the secondary conduit is adapted to impart a secondary venturi angle of 20-40 degrees.

11. The burner in accordance with claim 1 wherein a venturi arrangement acting on the flow from the primary conduit is adapted to impart a primary venturi angle of 20-40 degrees.

12. The burner in accordance with claim 1 wherein the annular space has a cross-sectional area that increases forwardly of the mixing zone.

13. The burner in accordance with claim 12 wherein the outer wall of the common conduit for common flow of the primary and secondary flows is provided with an outward flare forwardly of the mixing zone of less than 10 degrees.

14. The burner in accordance with claim 1 wherein the annular space has a cross-sectional area that decreases immediately before the burner outlet.

15. The burner in accordance with claim 1 wherein a flame holder is provided at the burner outlet.

16. The burner in accordance with claim 1 adapted for the combustion of particulate carbonaceous fuel.

17. A combustion apparatus comprising:

a combustion chamber; and at least one burner in accordance with claim 1 located so as to define combustion sites within the combustion chamber.

18. The combustion apparatus in accordance with claim 17 comprising a boiler for generating steam.

* * * * *